US011504639B2

(12) United States Patent
Cao

(10) Patent No.: US 11,504,639 B2
(45) Date of Patent: Nov. 22, 2022

(54) RECONFIGURABLE TOY VEHICLE LOOP

(71) Applicant: Mattel, Inc., El Segundo, CA (US)

(72) Inventor: Kevin Cao, Reseda, CA (US)

(73) Assignee: Mattel, Inc., El Segundo, CA (US)

( * ) Notice: Subject to any disclaimer, the term of this patent is extended or adjusted under 35 U.S.C. 154(b) by 49 days.

(21) Appl. No.: 17/146,818

(22) Filed: Jan. 12, 2021

(65) Prior Publication Data

US 2022/0219096 A1 Jul. 14, 2022

(51) Int. Cl.
*A63H 18/02* (2006.01)

(52) U.S. Cl.
CPC ..... *A63H 18/028* (2013.01); *A63H 18/021* (2013.01)

(58) Field of Classification Search
CPC ..... A63H 18/02; A63H 18/06; A63H 18/021; A63H 18/023; A63H 18/028
USPC ..... 446/444
See application file for complete search history.

(56) References Cited

U.S. PATENT DOCUMENTS

| | | | | |
|---|---|---|---|---|
| 712,407 | A | 10/1902 | Prescott | |
| 719,200 | A | 1/1903 | Dean | |
| 723,525 | A | 3/1903 | Hagen | |
| 1,209,127 | A | 12/1916 | Corey | |
| 1,725,536 | A | 8/1929 | Marx | |
| 2,992,598 | A | 7/1961 | Einfalt | |
| 3,316,401 | A | 4/1967 | Cramer | |
| 3,411,783 | A | 11/1968 | Montagna | |
| 3,604,148 | A | 9/1971 | Neuhierl | |
| 3,633,308 | A | 1/1972 | Yang | |
| 3,677,469 | A | 7/1972 | Edmisson et al. | |
| 3,708,116 | A | 1/1973 | Woodward | |
| 3,712,539 | A | 1/1973 | Staats | |
| 3,712,540 | A | 1/1973 | Yamasaki et al. | |
| 3,735,923 | A | 5/1973 | Brigham et al. | |
| 3,775,897 | A | 12/1973 | Soulakis et al. | |
| 3,860,237 | A | 1/1975 | Cooper et al. | |
| 4,203,247 | A | 5/1980 | Moe et al. | |
| 4,312,149 | A | 1/1982 | Iwao | |
| 4,513,966 | A | 4/1985 | Mucaro et al. | |
| 4,516,953 | A | 5/1985 | Hippely et al. | |
| 4,519,789 | A | 5/1985 | Halford et al. | |
| 4,558,867 | A | 12/1985 | Hippely | |
| 4,564,197 | A | 1/1986 | Lambert et al. | |
| 5,102,133 | A | 4/1992 | Chilton et al. | |
| 5,174,569 | A | 12/1992 | Ngai | |
| 5,299,969 | A | 4/1994 | Zaruba | |
| 5,440,996 | A * | 8/1995 | Cottino | A63H 19/30 246/415 A |
| 5,542,668 | A | 8/1996 | Casale et al. | |

(Continued)

*Primary Examiner* — Joseph B Baldori

(74) *Attorney, Agent, or Firm* — Edell, Shapiro & Finnan, LLC

(57) ABSTRACT

A loop track for toy vehicles comprising a baseplate and an extensible helical loop connected to the baseplate. The baseplate includes an inlet pathway and two or more outlet pathways positioned laterally along the baseplate. A first end of the helical loop is connected to the inlet pathway. A second end of the helical loop is removably connected to one of the two or more outlet pathways by laterally extending or contracting the helical loop. The loop track has a plurality of configurations and the configuration of the loop track is determined by the outlet pathway connected to the second end of the helical loop.

18 Claims, 8 Drawing Sheets

(56) References Cited

U.S. PATENT DOCUMENTS 5,586,923 A * 12/1996 Hippely ..... A63H 33/22 446/14
5,767,655 A 6/1998 Ostendorff et al.
6,241,573 B1 6/2001 Ostendorff et al.
6,358,112 B1 3/2002 Lambert et al.
6,478,654 B1 11/2002 Rehkemper et al.
6,676,480 B2 1/2004 Sheltman
6,783,419 B1 8/2004 Paukert et al.
6,951,497 B1 10/2005 Ngan
7,770,811 B2 8/2010 Belding
7,794,301 B2 9/2010 Ostendorff et al.
7,901,266 B2 3/2011 Ostendorff
8,192,246 B2 * 6/2012 Ostendorff ..... A63H 18/028 446/444
8,256,721 B2 * 9/2012 O'Connor ..... A63H 18/028 105/54
8,267,738 B2 9/2012 Nuttall
8,298,038 B2 10/2012 O'Connor et al.
8,323,069 B2 12/2012 Nuttall et al.
8,567,690 B2 10/2013 De La Torre
8,814,628 B2 8/2014 O'Connor et al.
8,876,573 B2 11/2014 O'Connor et al.
8,944,339 B2 2/2015 Ostendorff et al.
8,944,881 B2 2/2015 Payne
9,302,193 B2 * 4/2016 Chang ..... A63H 18/026
9,314,705 B2 4/2016 Payne et al.
9,345,980 B2 5/2016 Lee
10,265,634 B2 4/2019 Daly et al.
10,315,123 B2 6/2019 Cherednichenko et al.
10,471,364 B2 * 11/2019 Deutsch ..... A63H 19/30
10,653,972 B2 * 5/2020 Welby ..... A63H 18/028
2005/0287919 A1 12/2005 Sheltman et al.
2007/0037479 A1 2/2007 Margay
2009/0075558 A1 3/2009 Ostendorff
2010/0081356 A1 4/2010 Lutchen et al.
2012/0164914 A1 6/2012 O'Connor et al.
2012/0220183 A1 8/2012 Payne
2012/0309263 A1 12/2012 Lennon et al.
2013/0231028 A1 9/2013 Ostendorff et al.
2014/0097262 A1 4/2014 Ostendorff
2014/0206256 A1 7/2014 Chan et al.
2016/0310857 A1 10/2016 Effler et al.
2018/0250603 A1 9/2018 Colangelo
2020/0078697 A1 3/2020 Miller et al.
2020/0206642 A1 * 7/2020 Han ..... A63H 18/02
2021/0031118 A1 * 2/2021 Cao ..... A63H 18/02

* cited by examiner

RECONFIGURABLE TOY VEHICLE LOOP

FIELD OF THE INVENTION

The present invention relates generally to track sets for toy vehicles, and in particular, loop stunt tracks and structures used therein.

BACKGROUND OF THE INVENTION

Toy vehicles have long been enjoyed by people of all ages. The creation of track sets that allow toy vehicles to travel along guided pathways has further enhanced the enjoyment and play value of toy vehicles. Such track sets may include different features, obstacles, and/or interactive elements. For example, one popular track set feature is a vertically-oriented helical loop that a toy vehicle can travel along in apparent defiance of gravity. While there are numerous toy vehicle track sets and playsets in the art that include a loop structure, there is always a need and demand for novel loop tracks that can provide additional fun features and play value to toy vehicle track sets.

SUMMARY OF THE INVENTION

A reconfigurable loop track is described herein that provides a guided track for a toy vehicle to perform a loop stunt and continue along one of a plurality of possible exits or outlet pathways. The loop track has multiple configurations and can be easily reconfigured to change the outlet pathway that the toy vehicle is directed onto. By connecting different track segments or track sets to each outlet pathway, the loop track further functions as a hub that can direct toy vehicles to different track segments or track sets through a single point of entry.

In one embodiment of the loop track, the loop track comprises a baseplate and an extensible helical loop connected to the baseplate. The baseplate includes an inlet pathway and two or more outlet pathways positioned laterally along the baseplate. A first end of the helical loop is connected to the inlet pathway. A second end of the helical loop is removably connected to one of the two or more outlet pathways by laterally extending or contracting the helical loop. The loop track has a plurality of configurations and the configuration of the loop track is determined by the outlet pathway connected to the second end of the helical loop.

The baseplate of the loop track has a first side and a second side opposite the first side. Typically, the first end of the helical loop is connected to the inlet pathway on the first side of the baseplate and the second end of the helical loop is connected to one of the two or more outlet pathways on the second side of the baseplate. In some embodiments, the baseplate includes a plurality of recesses that form the inlet pathway and the two or more outlet pathways. In other embodiments, the two or more outlet pathways are positioned at different angles to the inlet pathway. In one instance, at least one of the outlet pathways is parallel to the inlet pathway.

In another embodiment of the loop track, the loop track comprises a baseplate including three or more track connectors and a helical loop connected to the baseplate that is configured to extend and contract laterally along the baseplate. A first end of the helical loop is removably connected to one of the track connectors and a second end of the helical loop is removably connected to one of the other track connectors. The loop track is reconfigured by changing the toy vehicle pathways connected to the first end and/or the second end of the helical loop. In some embodiments, at least one of the track connectors pivots on the baseplate. In other embodiments, at least one of the track connectors is repositionable laterally along the baseplate.

In yet another embodiment of the loop track, the loop track comprises a planar baseplate and a vertically-oriented extensible helical loop connected to the baseplate. The baseplate has a top, a bottom, a front side, and a rear side. The top of the baseplate includes a plurality of recesses that define an inlet pathway and two or more outlet pathways. The two or more outlet pathways are positioned laterally along the top of the baseplate at different angles to the inlet pathway. A first end of the helical loop is connected to the inlet pathway on the front side of the baseplate. A second end of the helical loop is removably connected to one of the two or more outlet pathways on the rear side of the baseplate. The loop track has a plurality of configurations and the configuration of the loop track is determined by the outlet pathway connected to the second end of the helical loop. Furthermore, the outlet pathway connected to the second end of the helical loop is selected by extending or contracting the helical loop laterally along the baseplate.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout.

DETAILED DESCRIPTION OF THE INVENTION

A loop track with multiple configurations is provided that is typically part of a larger track set or may be added to existing track sets to enhance their play value. The reconfigurable loop track includes an adjustable helical loop that allows a toy vehicle to perform a loop stunt while passing through the loop track. Furthermore, a user can extend and contract the adjustable helical loop to direct the toy vehicle onto different track segments or track sets that are connected to the loop track.

Figure 1A:
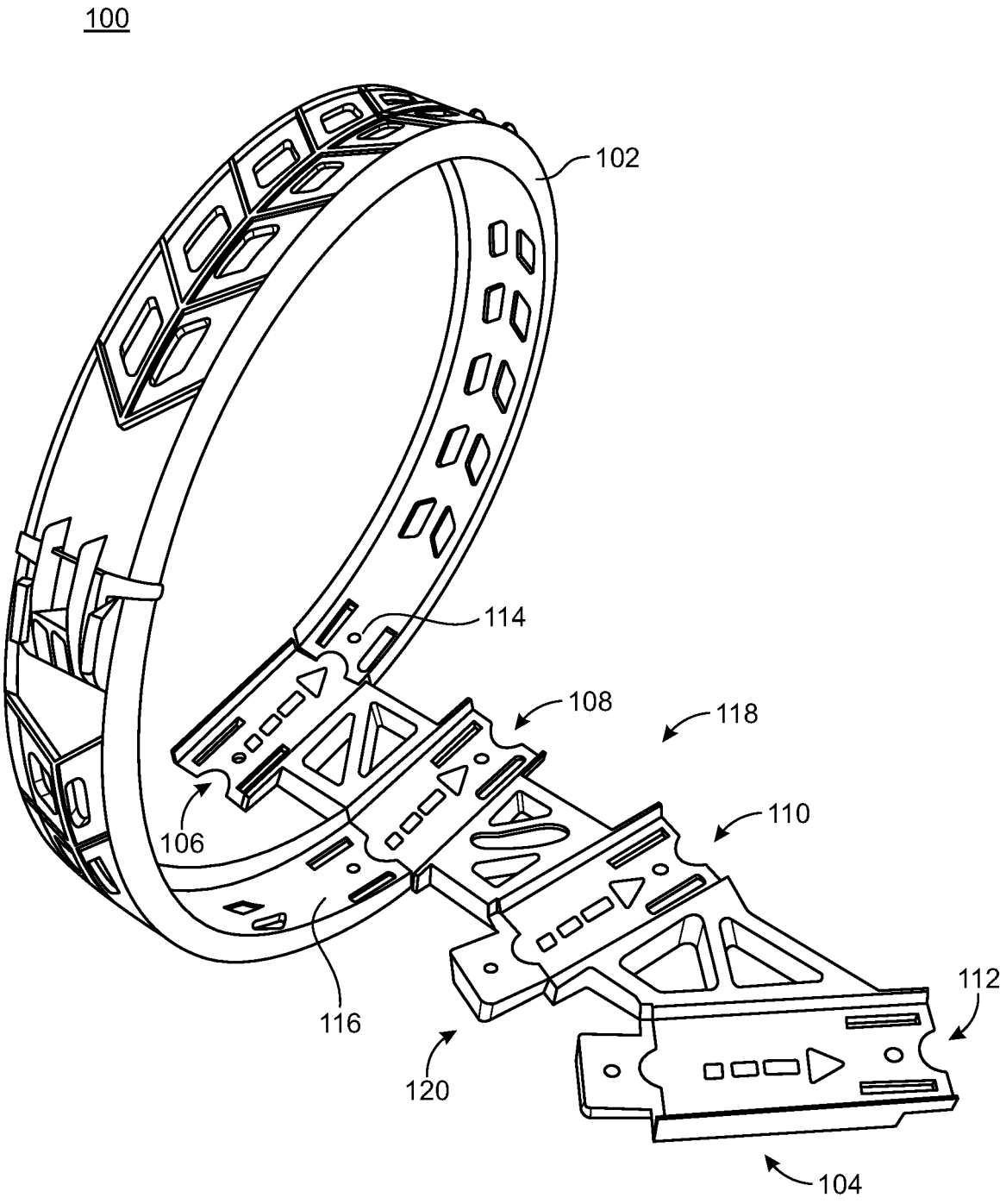
FIGS. 1A-1C illustrate a loop track in a first configuration (FIG. 1A), a second configuration (FIG. 1B), and a third configuration (FIG. 1C), in accordance with an embodiment of the invention.
Figure 1B:
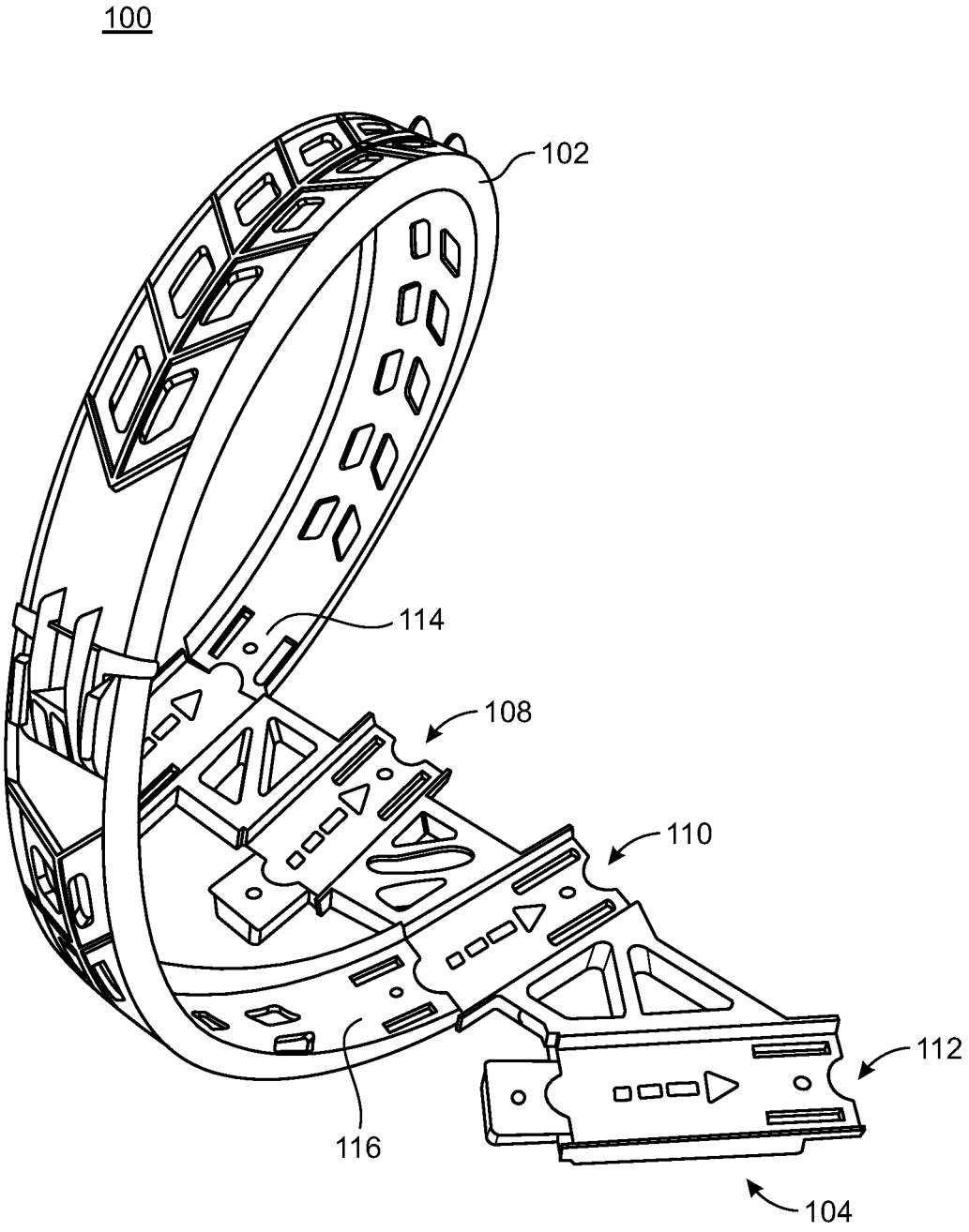
Figure 1C:
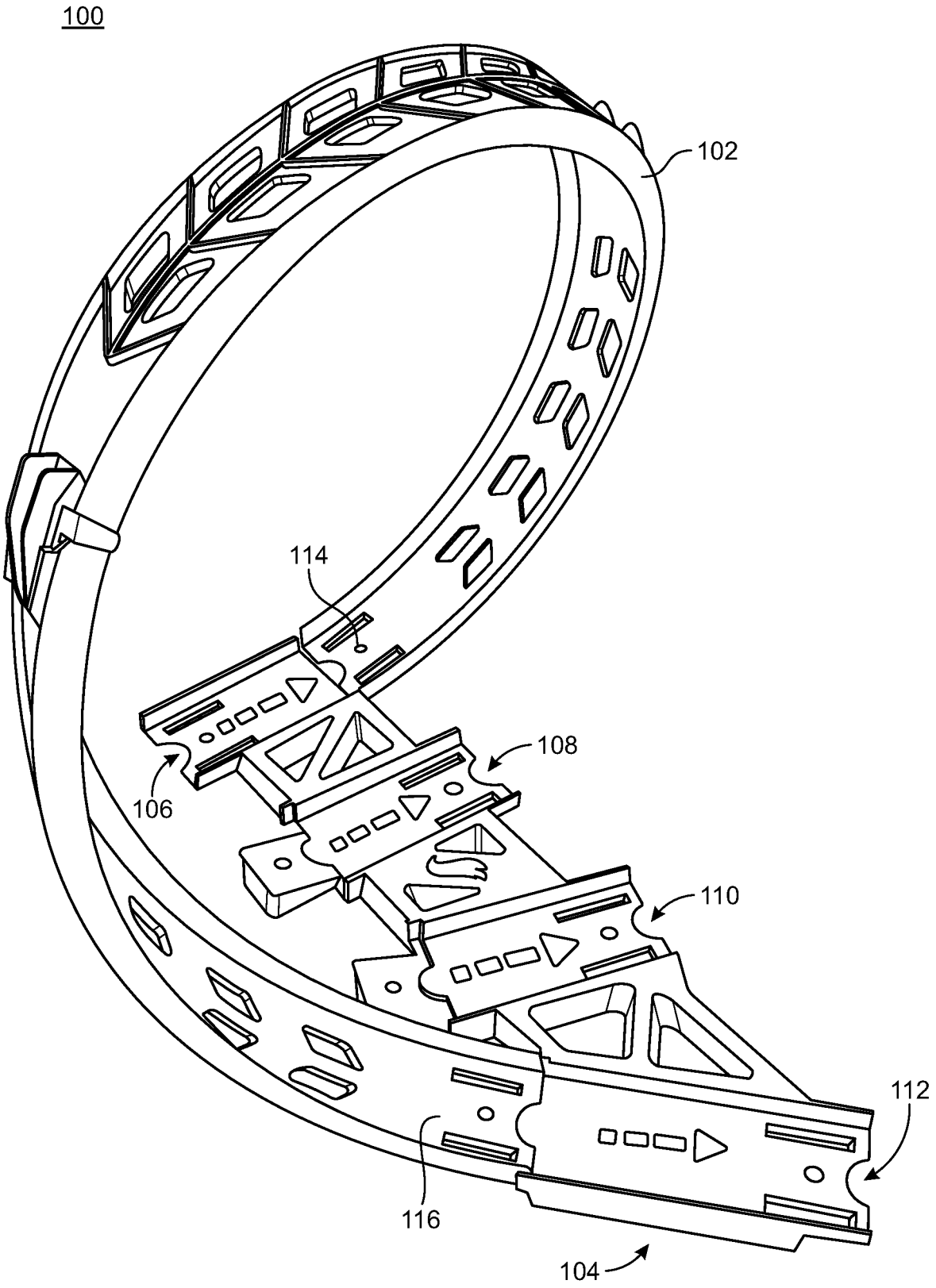

FIGS. 1A-1C set forth an illustrative example of the loop track and its multiple configurations. Loop track 100 comprises a helical loop 102 that is supported in a vertical orientation by a baseplate 104. Four pathways 106, 108, 110, 112 are positioned laterally along baseplate 104 and provide specific areas where helical loop 102 and other track segments can connect to loop track 100. More specifically, pathway 106 is an inlet pathway that a toy vehicle uses to enter helical loop 102 and pathways 108, 110, 112 are outlet pathways that are available to the toy vehicle after it exits helical loop 102. The outlet pathways 108, 110, 112 direct the toy vehicle onto track segments that may be connected to loop track 100 as part of a larger toy vehicle track set.

Helical loop 102 has a first end 114 and a second end 116. First end 114 is connected to inlet pathway 106 while second end 116 is connected to one of the outlet pathways 108, 110, 112, depending on the configuration of loop track 100. FIG. 1A shows loop track 100 in a first configuration where second end 116 is connected to outlet pathway 108. FIG. 1B shows loop track 100 in a second configuration where second end 116 is connected to outlet pathway 110. FIG. 1C shows loop track 100 in a third configuration where second end 116 is connected to outlet pathway 112. Though the example embodiment shown in FIGS. 1A-1C illustrates four pathways (i.e., one inlet pathway 106 and three outlet pathways 108, 110, 112) and three possible configurations, other embodiments of the loop track may have a different number of pathways and configurations. A minimum of three vehicle pathways (e.g., one inlet pathway and two outlet pathways) and two possible configurations is required so that the loop track can function as a reconfigurable hub that provides access to different track segments. Embodiments of the loop track also include those having five or more vehicle pathways and four or more possible configurations.

Figure 2B:
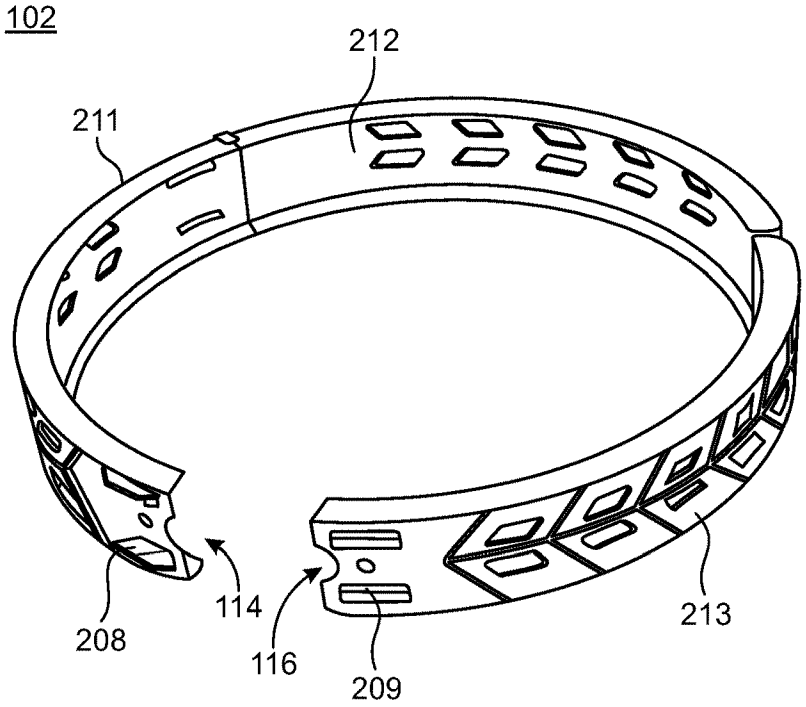
FIGS. 2A-2B illustrate the baseplate (FIG. 2A) and helical loop (FIG. 2B) of the loop track of FIG. 1, in accordance with an embodiment of the invention.
Figure 2A:
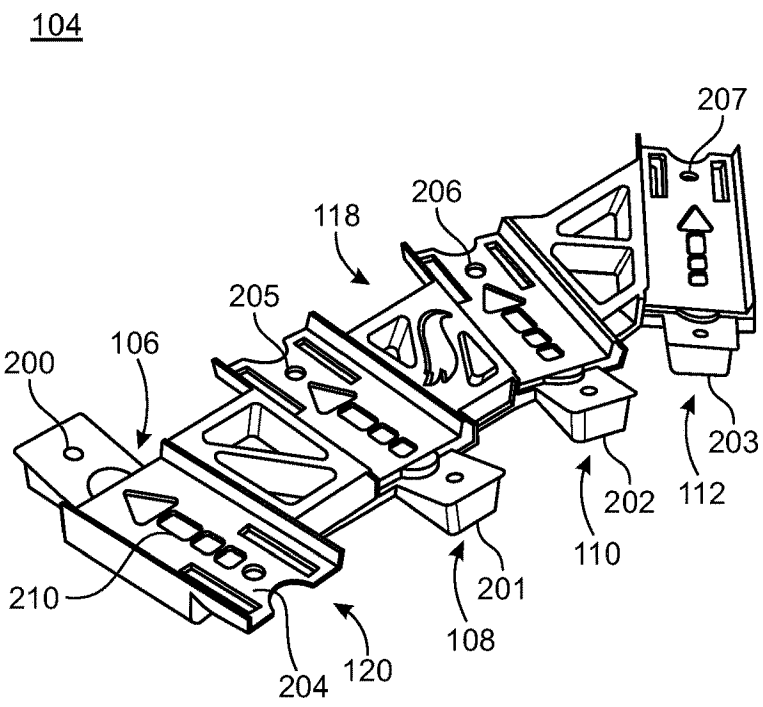

FIGS. 2A and 2B provide a closer look at baseplate 104 (FIG. 2A) and helical loop 102 (FIG. 2B), which are assembled together to form loop track 100. Recessed portions of baseplate 104 form pathways 106, 108, 110, 112, which each have the same width as helical loop 102 and are sized to accommodate the width of a toy vehicle. Providing baseplate 104 and pathways 106, 108, 110, 112 as a single unitary component simplifies its production and consequently reduces its manufacturing cost. Pathways 106, 108, 110, 112 further include connector portions 200-207 along a front side 118 and rear side 120 of baseplate 104. The connector portions may be any structure suitable for facilitating selective end-to-end coupling of helical loop 102 or other track segments to pathways 106, 108, 110, 112. For instance, connector portions 200-207 are male and female connector portions for a tongue-and-groove, friction-fit connection system.

More specifically, each pathway 106, 108, 110, 112 includes a male helical connector portion and a female track connector portion for respectively engaging helical loop 102 and other compatible track segments. Helical connector portions 200-203 are configured to engage with grooves 208 or 209 on the underside of first end 114 or second end 116 of helical loop 102 (see FIG. 2B). Furthermore, helical connector portions 200-203 are preferably angled to baseplate 104 to facilitate their engagement with the ends 114, 116 of helical loop 102, as well as to create a smooth transition for a toy vehicle traveling from baseplate 104 onto helical loop 102 and from helical loop 102 back onto baseplate 104. Track connector portions 204-207 are configured to engage with the ends of other compatible track segments, for instance with the use of dual-ended male track joiners.

Additionally, helical connector portion 200 for inlet pathway 106 is located at the front side 118 of baseplate 104, while helical connector portions 201-203 for respective outlet pathways 108, 110, 112 are located at the rear side 120 of baseplate 104. On the opposite ends of the pathways, track connector portion 204 for inlet pathway 106 is located at the rear side 120 of baseplate 104, while track connector portions 205-207 for respective outlet pathways 108, 110, 112 are located at the front side 118 of baseplate 104. The arrangement of helical connector portions 200-203 and track connector portions 204-207 helps indicate to a user where helical loop 102 and additional track segments can be connected to baseplate 104 and prevents loop track 100 from being configured in a non-functional layout. For example, the user is prevented from respectively connecting the first end 114 and second end 116 of helical loop 102 to the front side 118 and rear side 120 of the same inlet pathway 106, which would create a circular loop with no inlet or outlet. Additionally, each pathway includes a marker 210 to further indicate to a user the intended direction that a toy vehicle travels when passing through loop track 100.

Connector portions 200-207 are configured to allow ends 114, 116 of helical loop 102 to easily connect to and disconnect from the pathways of baseplate 104. Thus, a user can easily reconfigure loop track 100 and change the outlet pathway connected to helical loop 102 as desired. In the illustrative embodiment shown in FIGS. 1A-1C, both ends 114, 116 of helical loop 102 are removably connected to baseplate 104. This allows loop track 100 to be disassembled into the separate helical loop 102 and baseplate 104 components shown in FIGS. 2A and 2B for storage purposes. In some embodiments, only the end of the helical loop that is connected to an outlet pathway can be disconnected and the other end of the helical loop is fixedly connected to the inlet pathway or formed as part of the inlet pathway.

Outlet pathways 108, 110, 112 are further positioned at various angles to inlet pathway 106. Stretching or extending helical loop 102 laterally to move second end 116 in a direction away from inlet pathway 106 causes second end 116 to angularly rotate (see, e.g., FIGS. 1A-1C). Outlet pathways 108, 110, 112 are therefore positioned accordingly to accommodate the angular shift of second end 116. Specifically, outlet pathways 108, 110, 112 are positioned along baseplate 104 at progressively greater angles with respect to inlet pathway 106. Among the three outlet pathways 108, 110, 112, outlet pathway 108 is the closest to inlet pathway 106 and is positioned with the least angular difference to inlet pathway 106. In comparison, outlet pathway 112 is the furthest from inlet pathway 106 and is positioned with the greatest angular difference to inlet pathway 106. In some embodiments, one or more of the outlet pathways is parallel to the inlet pathway. Positioning outlet pathways 108, 110, 112 at progressively greater angles with respect to inlet pathway 106 optimizes the space available to the track segments or track sets that may be connected to each outlet pathway. In contrast, if outlet pathways 108, 110, 112 were all parallel to inlet pathway 106, the size of the track segments or track sets that may be connected to outlet pathways 108, 110, 112 would be more restricted in order to not obstruct each other.

In the illustrative embodiment shown in FIG. 2B, helical loop 102 comprises three arcuate pieces 211, 212, 213 that are coupled together to form helical loop 102. Arcuate pieces 211, 212, 213 allow helical loop 102 to be disassembled into separate components for easier storage. In other embodiments, the helical loop may be formed from a different number of pieces or components, such as a single piece or two arcuate pieces (see arcuate pieces 429, 430 of helical loop 402 in FIG. 4).

Figure 3B:
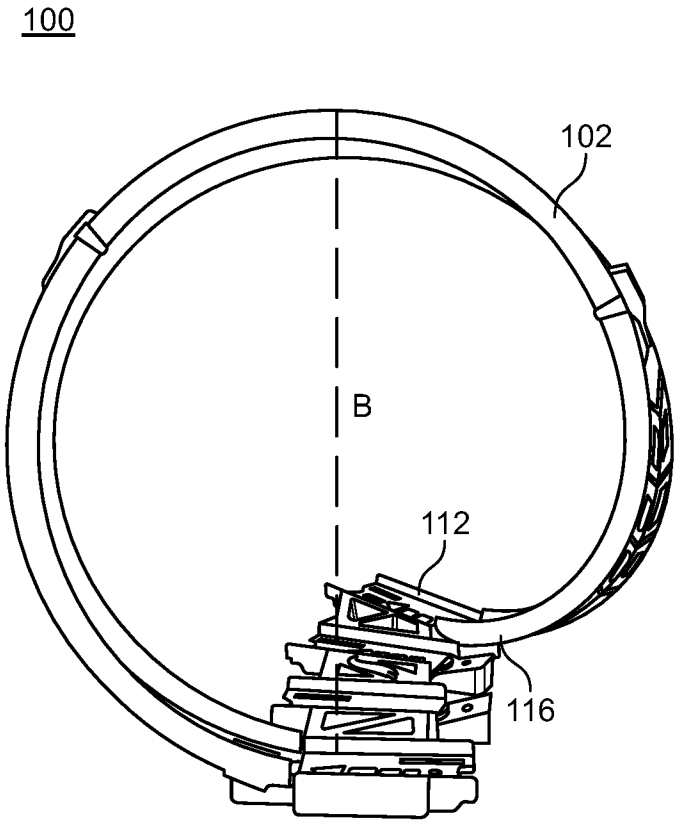
FIGS. 3A-3B illustrate side views of the loop track of FIG. 1 in the first configuration (FIG. 3A) and in the third configuration (FIG. 3B), in accordance with an embodiment of the invention.
Figure 3A:
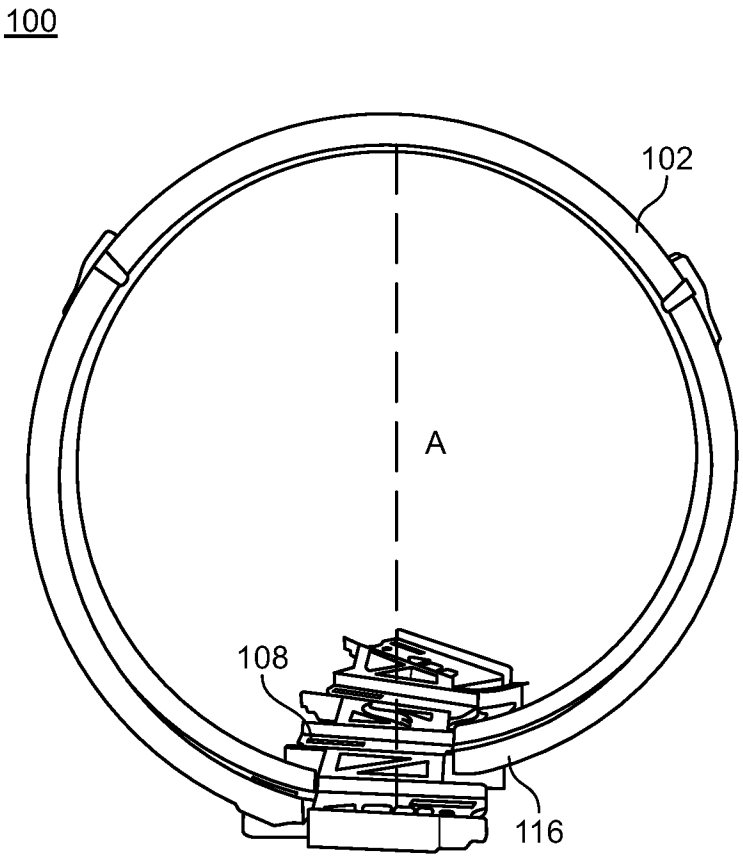

Helical loop 102 is fabricated from a flexible material that allows it to extend or contract laterally as second end 116 is moved between outlet pathways 108, 110, 112 (see, e.g., FIGS. 1A-1C). As helical loop 102 is extended or contracted to different lengths in the various configurations of loop track 100, the height and shape of helical loop 102 in the various configurations of loop track 100 also changes. As shown in FIG. 3A, when second end 116 is connected to outlet pathway 108 (i.e., first configuration of loop track 100), helical loop 102 has a height A and a generally circular shape. As shown in FIG. 3B, when second end 116 is connected to outlet pathway 112 (i.e., third configuration of loop track 100), helical loop 102 has a height B that is less than height A and a shape that is more oblong. Because the height and/or shape of helical loop 102 is different for each loop track configuration, changing the configuration of loop track 100 not only allows a toy vehicle to travel along different track segments or track sets connected to loop track 100, but also provides different loop stunt experiences as the toy vehicle travels along helical loop 102.

Figure 4:
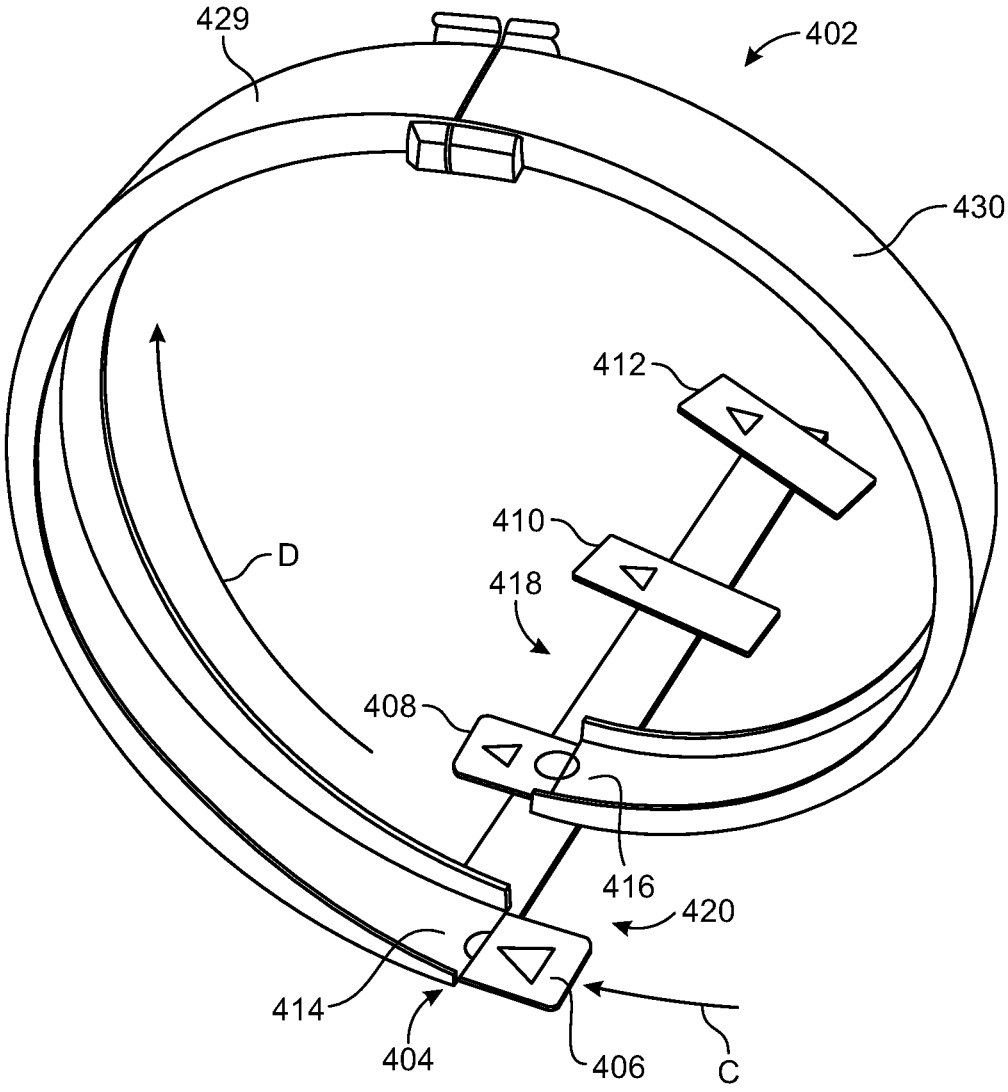
FIG. 4 illustrates a loop track in accordance with another embodiment of the invention.
Figure 5:
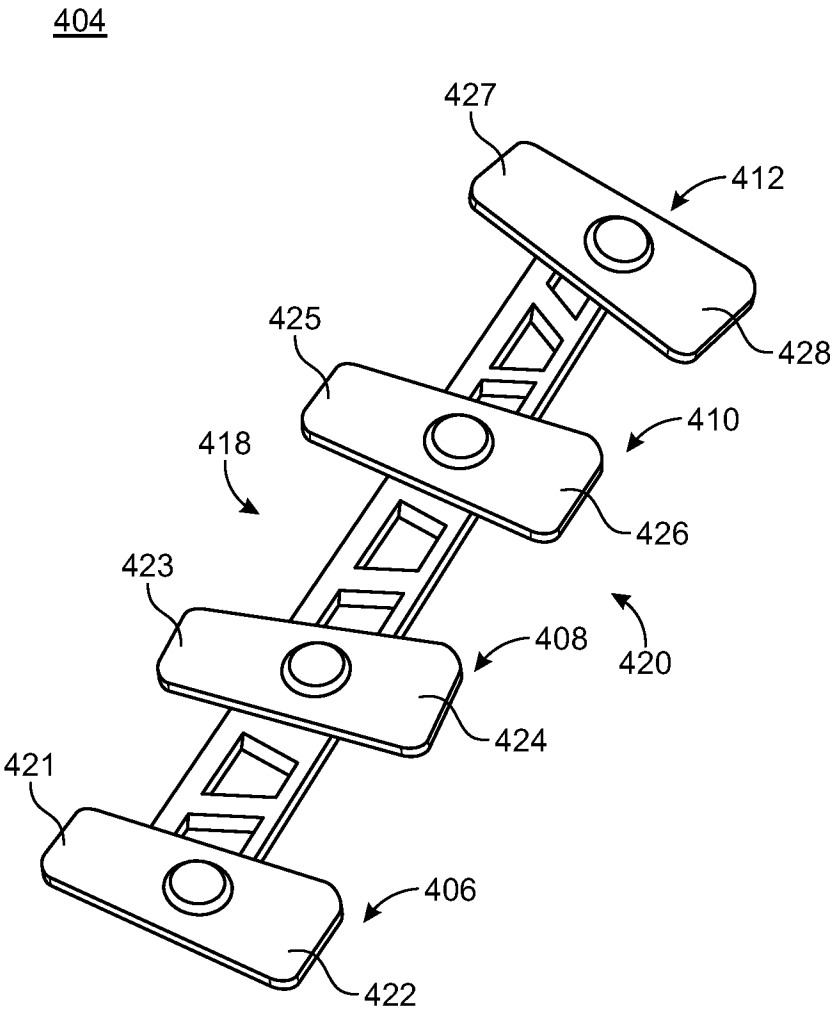
FIG. 5 illustrates the baseplate of the loop track of FIG. 4, in accordance with an embodiment of the invention.

FIGS. 4 and 5 provide another illustrative embodiment of the loop track. Loop track 400 comprises a helical loop 402 that is supported in a vertical orientation by a baseplate 404. Four pathways in the form of track connectors 406, 408, 410, 412 are positioned laterally along baseplate 404, with each track connector having dual-ended male connector portions 421-428 (see, e.g., FIG. 5). Furthermore, unlike pathways 106, 108, 110, 112 of loop track 100 (see FIG. 2A), track connectors 406, 408, 410, 412 do not have recessed surfaces for a toy vehicle to travel on but instead allow the ends 414, 416 of helical loop 402 to be directly joined to the ends of track segments connected to loop track 400.

Track connectors 406, 408, 410, 412 are similarly structured and may be used for both inlet and outlet purposes. This allows loop track 400 to have a wide range of possible configurations. First end 414 of helical loop 402 can be connected to any of the track connectors 406, 408, 410, 412 on the front side 418 or rear side 420 of baseplate 404, and second end 416 of helical loop 402 can be connected to any of the track connectors 406, 408, 410, 412 on the other side. Thus, loop track 400 has twelve possible configurations, excluding non-functional configurations where the two ends 414, 416 of helical loop 402 are connected to the same track connector. Additional track segments may also be connected to any of the available track connectors. In the configuration shown in FIG. 4, a toy vehicle enters loop track 400 in a direction C through track connector 406, performs a loop stunt D along helical loop 402, and exits loop track 400 through track connector 408.

Figure 6:
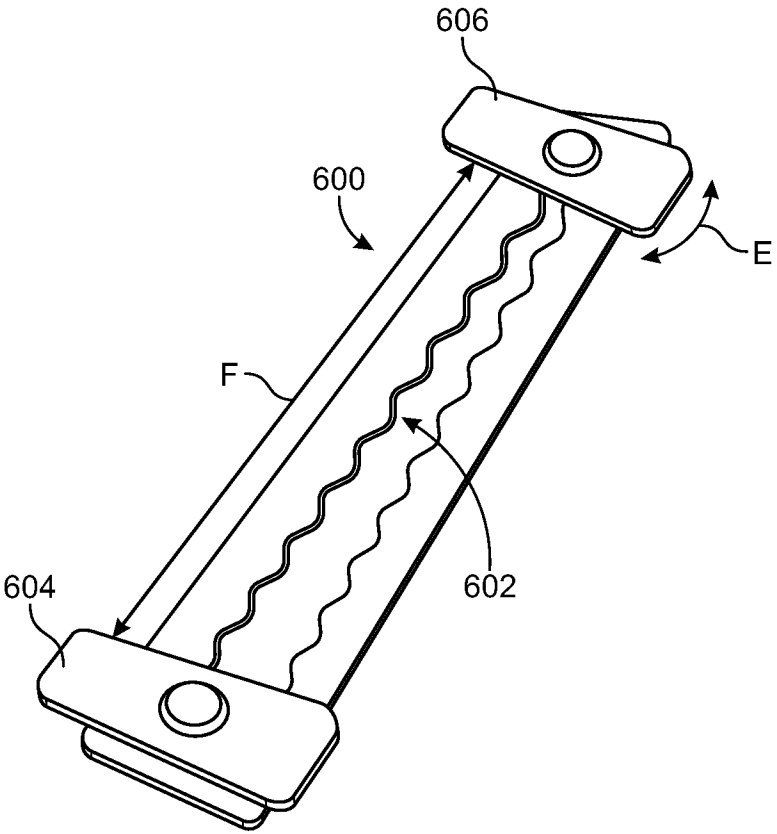
FIG. 6 illustrates a baseplate with adjustable and rotatable track connectors, in accordance with another embodiment of the invention.

Furthermore, track connectors 406, 408, 410, 412 are fixedly positioned at various angles along baseplate 404. As described earlier, this helps optimize the space available to the track segments or track sets that may be connected to each track connector, as well as accommodates the angular shifting of ends 414, 416 as helical loop 402 is expanded or contracted among the different loop track configurations. In other embodiments, track connectors 406, 408, 410, 412 are pivotably coupled on baseplate 404, which allows the angle of each track connector to be adjusted. FIG. 6 shows another embodiment of a baseplate 600 that includes track connectors 604, 606 which can be pivoted (for example along direction E) as well as adjusted laterally in direction F along a central channel 602 on baseplate 600. In this instance, channel 602 has a zigzag shape that helps retain track connectors 604, 606 at desired positions. Furthermore, even though only two track connectors 604, 606 are depicted in the illustrative example shown in FIG. 6, baseplate 600 may include additional track connectors that can also be rotatably and laterally adjusted along central channel 602.

Figure 7A:
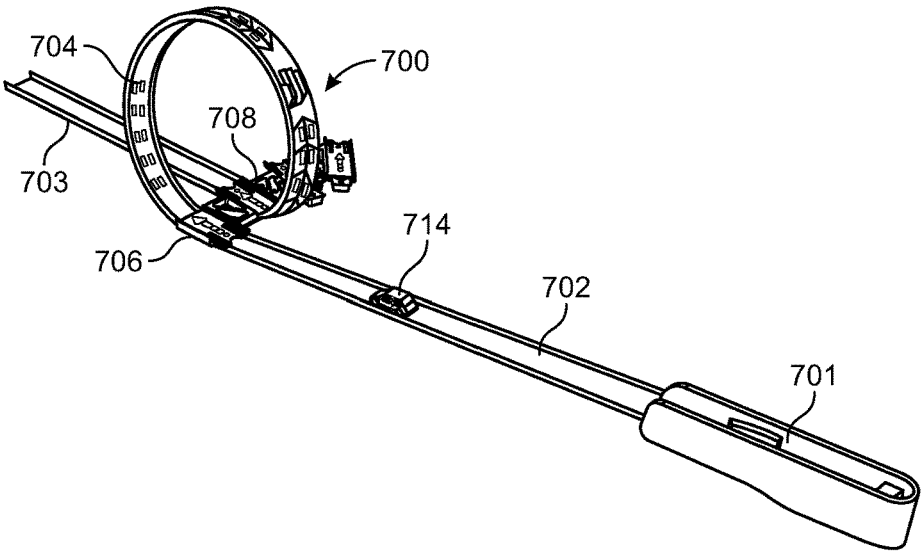
FIGS. 7A-7C illustrate a loop track in a first configuration (FIG. 7A), a second configuration (FIG. 7B), and a third configuration (FIG. 7C) with connected track segments, in accordance with an embodiment of the invention.
Figure 7B:
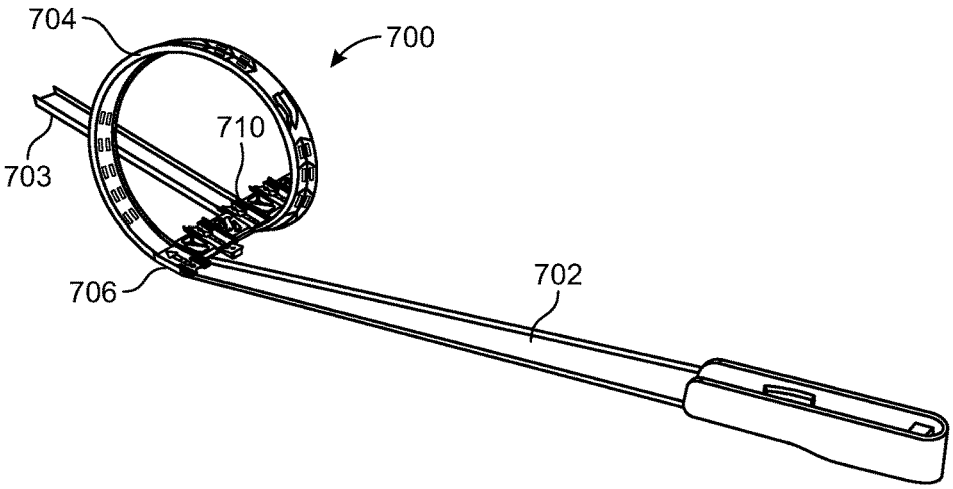
Figure 7C:
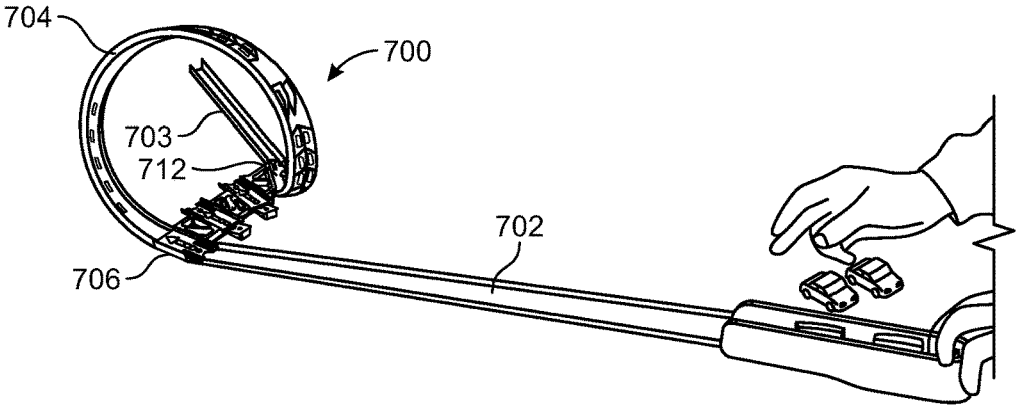

FIGS. 7A-7C show an exemplary implementation of a loop track 700 in different configurations while connected with compatible track segments 702, 703. FIG. 7A shows loop track 700 in a first configuration with track segment 702 connected to an inlet pathway 706, and helical loop 704 and track segment 703 connected to opposite ends of a first outlet pathway 708. FIG. 7B shows loop track 700 in a second configuration with track segment 702 still connected to inlet pathway 706, but with helical loop 704 and track segment 703 now connected to opposite ends of a second outlet pathway 710. FIG. 7C shows loop track 700 in a third configuration with track segment 702 still connected to inlet pathway 706, but with helical loop 704 and track segment 703 now connected to opposite ends of a third outlet pathway 712. Additionally, a toy vehicle launcher 701 is connected to track segment 702 and is used to launch a toy vehicle (see, e.g., vehicle 714 in FIG. 7A) towards loop track 700.

With all three loop track configurations, a launched toy vehicle travels along track segment 702 and enters loop track 700 via inlet pathway 706. Upon successful completion of a loop stunt along helical loop 704, the toy vehicle is directed to one of the outlet pathways 708, 710, 712 depending on the configuration of loop track 700. The toy vehicle then exits loop track 700 via the selected outlet pathway and continues onto track segment 703, which may be further connected to additional track segments or track sets. Thus, loop track 700 may be reconfigured to provide three different raceways and loop stunt experiences for a toy vehicle launched from launcher 701. Furthermore, although FIGS. 7A-7C show track segment 703 being moved to different outlet pathways for each configuration, multiple track segments may be connected to all three outlet pathways 708, 710, 712 at the same time. This allows the different raceways to be accessed by simply changing the outlet pathway connected to helical loop 704.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

For example, as described above, a toy vehicle typically enters the loop track through a single inlet pathway and exits through one of a plurality of possible outlet pathways. However, in some embodiments, the loop track is used in the opposite direction and allows a toy vehicle to enter the loop track through one of the plurality of outlet pathways and exit through the inlet pathway. Here, the loop track may be reconfigured to allow toy vehicles from different raceways to perform a loop stunt and continue onto the same raceway.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention. Finally, various features from one of the embodiments may be incorporated into another of the embodiments.

The invention claimed is:

1. A loop track for toy vehicles, the loop track comprising:

a baseplate including a first side, an opposite second side, an inlet pathway and two or more outlet pathways positioned laterally along the baseplate and spanning between the first side and the second side, the inlet pathway and the two or more outlet pathways each having a male connector portion and a female connector portion, the male connector portion of the inlet pathway being disposed on the first side of the baseplate and the male connector portion of each of the two or more outlet pathways being disposed on the second side of the baseplate; and an extensible helical loop connected to the baseplate, wherein a first end of the helical loop is connected to the male connector portion of the inlet pathway and a second end of the helical loop is removably connected to the male connector portion of one of the two or more outlet pathways by laterally extending or contracting the helical loop;

wherein the loop track has a plurality of configurations and the configuration of the loop track is determined by the outlet pathway connected to the second end of the helical loop.

2. The loop track of claim 1, wherein a height and/or shape of the helical loop in each configuration is different.

3. The loop track of claim 1, wherein the baseplate is further disposed in a horizontal plane, and the two or more outlet pathways are horizontally offset at different angles along the horizontal plane from the inlet pathway.

4. The loop track of claim 1, wherein at least one of the outlet pathways is parallel to the inlet pathway.

5. The loop track of claim 1, wherein the helical loop comprises two or more arcuate tracks that are connected together to form the helical loop.

6. The loop track of claim 1, wherein the inlet pathway and the two or more outlet pathways are each formed as a recess in the baseplate.

7. A reconfigurable loop track for toy vehicles, the loop track comprising:

a baseplate including a first side, an opposite second side, and three or more track connectors spanning between the first side and the second side, each track connector of the three or more track connectors having a male connector portion and a female connector portion; and a helical loop connected to the baseplate, the helical loop configured to extend and contract laterally along the baseplate, wherein a first end of the helical loop is removably connected to the male connector portion of a first track connector of the track connectors that is disposed on the first side of the baseplate and a second end of the helical loop is removably connected to a male connector portion of a second or a third track connector of the track connectors that is disposed on the second side of the baseplate;

wherein the loop track is reconfigured by changing the track connectors connected to the first end and/or the second end of the helical loop.

8. The loop track of claim 7, wherein the helical loop comprises two or more arcuate tracks that are connected together to form the helical loop.

9. The loop track of claim 7, wherein each track connector is formed as a recess in the baseplate that defines a toy vehicle pathway.

10. The loop track of claim 7, wherein at least one of the track connectors pivots on the baseplate.

11. The loop track of claim 7, wherein at least one of the track connectors is repositionable laterally along the baseplate.

12. A loop track for toy vehicles, the loop track comprising:

a planar baseplate having a top, a bottom, a front side, and a rear side, the baseplate being disposed in a horizontal plane;

an inlet pathway and two or more outlet pathways formed as a plurality of recesses in the top of the baseplate, the two or more outlet pathways positioned laterally along the top of the baseplate such that the two or more outlet pathways are horizontally offset at different angles along the horizontal plane from the inlet pathway the two or more outlet pathways spanning between the front side and the rear side, the inlet pathway and the two or more outlet pathways each having a male connector portion and a female connector portion, the male connector portion of the inlet pathway being disposed on the front side of the baseplate and the male connector portion of each of the two or more outlet pathways being disposed on the rear side of the baseplate; and a vertically-oriented extensible helical loop connected to the baseplate, wherein a first end of the helical loop is connected to the male connector portion of the inlet pathway on the front side of the baseplate, and a second end of the helical loop is removably connected to one of the two or more outlet pathways on the rear side of the baseplate;

wherein the loop track has a plurality of configurations, the configuration of the loop track is determined by the outlet pathway connected to the male connector portion of one of the two or more outlet pathways, and the outlet pathway connected to the second end of the helical loop is selected by extending or contracting the helical loop laterally along the baseplate.

13. The loop track of claim 12, wherein a height and/or shape of the helical loop in each configuration is different.

14. The loop track of claim 12, wherein the first end of the helical loop is removably connected to the inlet pathway.

15. The loop track of claim 12, wherein at least one of the outlet pathways is parallel to the inlet pathway.

16. The loop track of claim 12, wherein the helical loop comprises two or more arcuate tracks that are connected together to form the helical loop.

17. The loop track of claim 16, wherein the helical loop comprises three identical arcuate tracks that are connected together to form the helical loop.

18. The loop track of claim 12, wherein track segments are connected to the inlet pathway on the rear side of the baseplate and each of the two or more outlet pathways on the front side of the baseplate.

* * * * *